United States Patent [19]

Yo

[11] Patent Number: 5,065,594

[45] Date of Patent: Nov. 19, 1991

[54] AUTOMATIC PURGER FOR ABSORPTION HEAT PUMP

[75] Inventor: Yuh-Yuan Yo, Chutung, Taiwan

[73] Assignee: Industrial Technology Research Institute, Taiwan, Taiwan

[21] Appl. No.: 581,546

[22] Filed: Sep. 12, 1990

[51] Int. Cl.[5] ..... F25B 43/04

[52] U.S. Cl. ..... 62/195; 62/475

[58] Field of Search ..... 62/475, 474, 483, 487, 62/488, 195

[56] References Cited

U.S. PATENT DOCUMENTS

| | | | |
|---|---|---|---|
| 1,889,191 | 11/1932 | Baumann | 62/475 |
| 1,892,869 | 1/1933 | Comstock | 62/475 |
| 2,374,564 | 4/1945 | Reid, Jr. et al. | 62/475 |
| 2,494,972 | 1/1950 | Thomas et al. | 62/475 |
| 3,146,602 | 9/1964 | Swearingen | 62/475 |

FOREIGN PATENT DOCUMENTS

| | | | |
|---|---|---|---|
| 0065114 | 11/1946 | Denmark | 62/475 |
| 5083710 | 1/1977 | Japan | 62/475 |

*Primary Examiner*—Albert J. Makay

*Assistant Examiner*—William C. Doerrler

[57] ABSTRACT

An automatic purger for an absorption heat pump has a generator, a condensor, an evaporator and an absorber. The purger includes an eductor connected to the absorber, a purging chamber connected to the absorber and mounting therein a nozzle, a heat-dissipating tube connected between the educator and the nozzle, a storage tank communicating with the absorber and mounting thereto a solution level controller, a diffuser for increasing the pressure of the absorbing agent solution ejected from the nozzle into the storage tank, and a vacuum pump connected to the storage tank. Due to a low pressure zone formed around the exit of the nozzle in the purging chamber, non-condensable gas existing in the absorber will be extracted into the purging chamber and then be carried into the storage tank by the absorbing agent solution ejected from the nozzle. The vacuum pump will be actuated to begin to purge non-condensable gas when the storage tank reaches a predetermined low solution level, and be deenergized to stop purging when the storage tank reaches a predetermined high solution level.

2 Claims, 3 Drawing Sheets

AUTOMATIC PURGER FOR ABSORPTION HEAT PUMP

BACKGROUND OF THE INVENTION

The present invention relates generally to an absorption heat pump and particularly to a purger therefor.

As industry is booming and the living standard is upgraded, the air-conditioning system is getting more and more popular, which means that more and more electric power is needed. Consequently, developed industrial countries have to find every possible means to develop new kinds of air-conditioning systems which are capable of saving electric power. It is found that absorption heat pump systems driven by heat energy call for the least electrical power. Besides, it is possible to drive the absorption heat pump by recovering heat energy for industrial exhaust fluid so as to utilize energy in very economic way. It was reported that, within the year of 1988, the Japanese sold totally 6541 sets of absorption heat pump, amoung which 2409 sets are over 50 RT.

The absorption heat pump capable of generating either hot or cold water for use and having a working principle different from that of a coventional compression air-conditioning system mainly includes a condenser and an evaporator as in a conventional cooling system, and an absorber and a generator instead of a conventional compressor for respectively absorbing refrigerant by means of absorbing agent and releasing vapor refrigerant produced. The cold-making effect is performed by the evaporator in which the refrigerant is changed from liquid state into gas state. In the circumstances that the absorbing agent is lithum bromide solution and the refrigerant is water, the vapor refrigerant coming from the evaporator is absorbed by the lithum bromide solution in the absorber under an extremely low pressure of about 4–6 mm Hg. Due to the slight leakage of the heat pump and also the oxidation of the heat pump which will produce hydrogen, some non-condensable gas which is neither soluble in the working fluid nor condensable at a lower temperature. With the accumulation of non-condensable gases, the presssure in the absorber will gradually increase, raising the evaporating temperature of the refrigerant. In addition, the non-condensable gas will mix with the vapor refrigerant to form therearound a film hindering the vapor refrigerant from being absorbed by the absorbing agent so that the cooling capacity of the heat pump system is greatly reduced.

Generally, a commercialized absorption heat pump system is provided with a purging device for purging or extracting the non-condensable gas, which is normally achieved by utilizing a nozzle through which the less dense working fluid having absorbed to refrigerant (water) is caused to flow to produce a local low pressure area trapping thereto the non-condensible gas being then discharged to a storage tank. Since the lithum bromide solution has a better absorptivity at a lower temperature, if the temperature of the solution flowing through the nozzle is lowered to increase the ability of the lithum bromide solution in absorbing the vapor refrigerant, the purging effect will be improved or a lower pressure area will be obtained. This is the reason why some manufacturers add in the heat pump system a cooling pipeline. However, this can be troublesome if there is blockage therein; and leakage may occur and change the density of the working fluid or the operating situation of the system if there is a corroded pipe in the pipeline.

SUMMARY OF THE INVENTION

It is therefore a primary object of the present invention to provide an automatic purger for an absorption heat pump system.

It is a further object of the present invention to provide a purger for an absorption heat pump system, which purger can have an improved purging ability without the provision of a cooling pipeline.

In accordance with a preferred embodiment of the present invention, a purger for an absorption heat pump having a generator, a condenser, an evaporator and an absorber comprises an eductor connected to the absorber, a purging chamber connected to the absorber and mounting therein a nozzle, a storage tank communicating with the absorber and mounting thereto a solution level controller, a diffuser connected between the purging chamber and the storage tank for increasing the pressure of absorbing agent solution discharged from the nozzle into the storage tank, and a vacuum pump connected to the storage tank so that the vacuum pump will be actuated when the storage tank reaches a predetermined low solution level, and the vacuum pump will be deenergized when the storage tank reaches a predetermined high solution level.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention can be more fully understood by reference to the following description and accompanying drawings, which form an integral part of the present invention and which are given by way of illustration only, and thus are not limitative of the present invention, and wherein.

DETAILED DESCRIPTION OF THE PREFERRED EMBODIMENT

Figure 1:
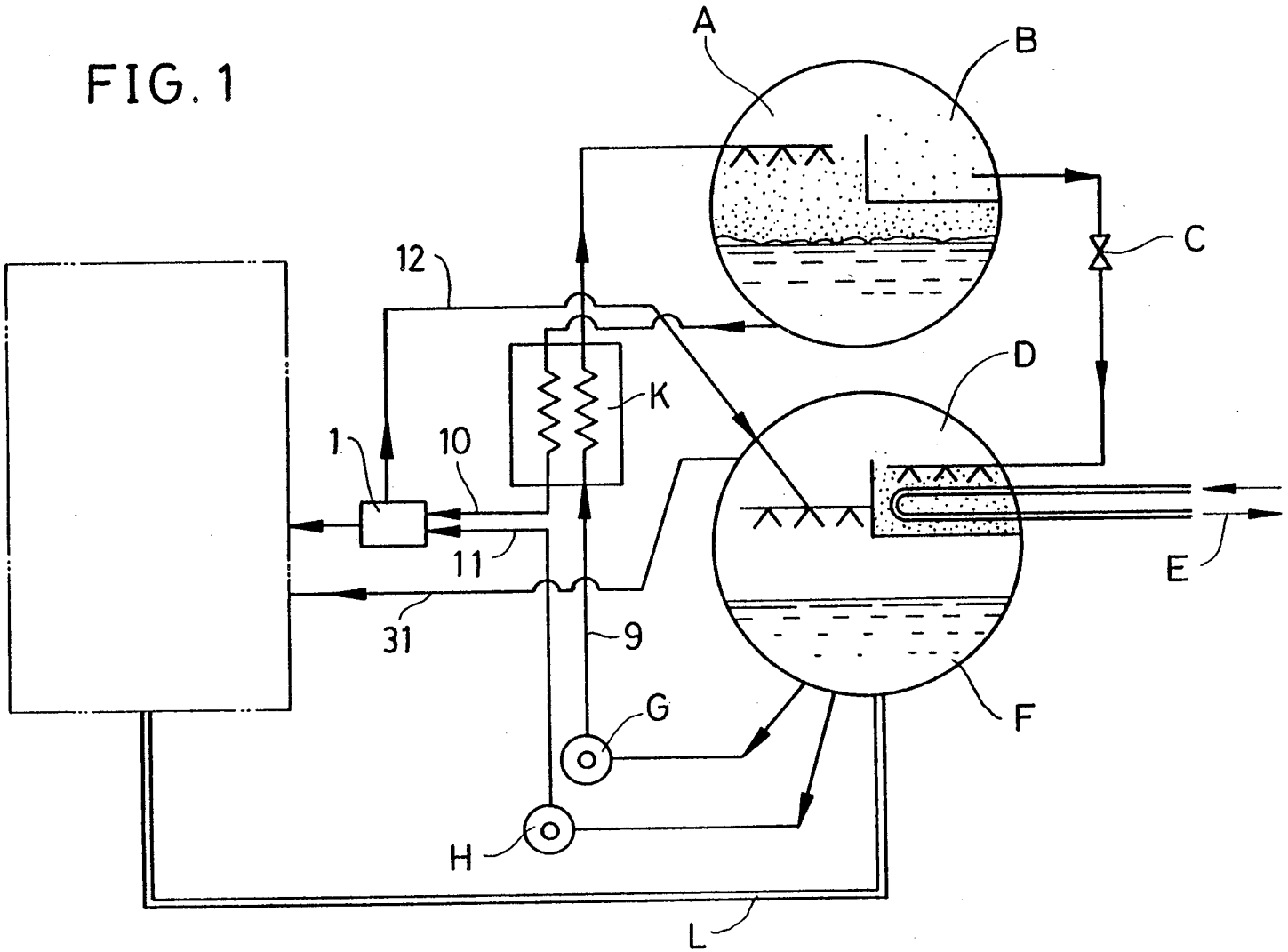
FIG. 1 is a schematic view showing an absorption heat pump incorporating a purger according to the present invention.
Figure 2:
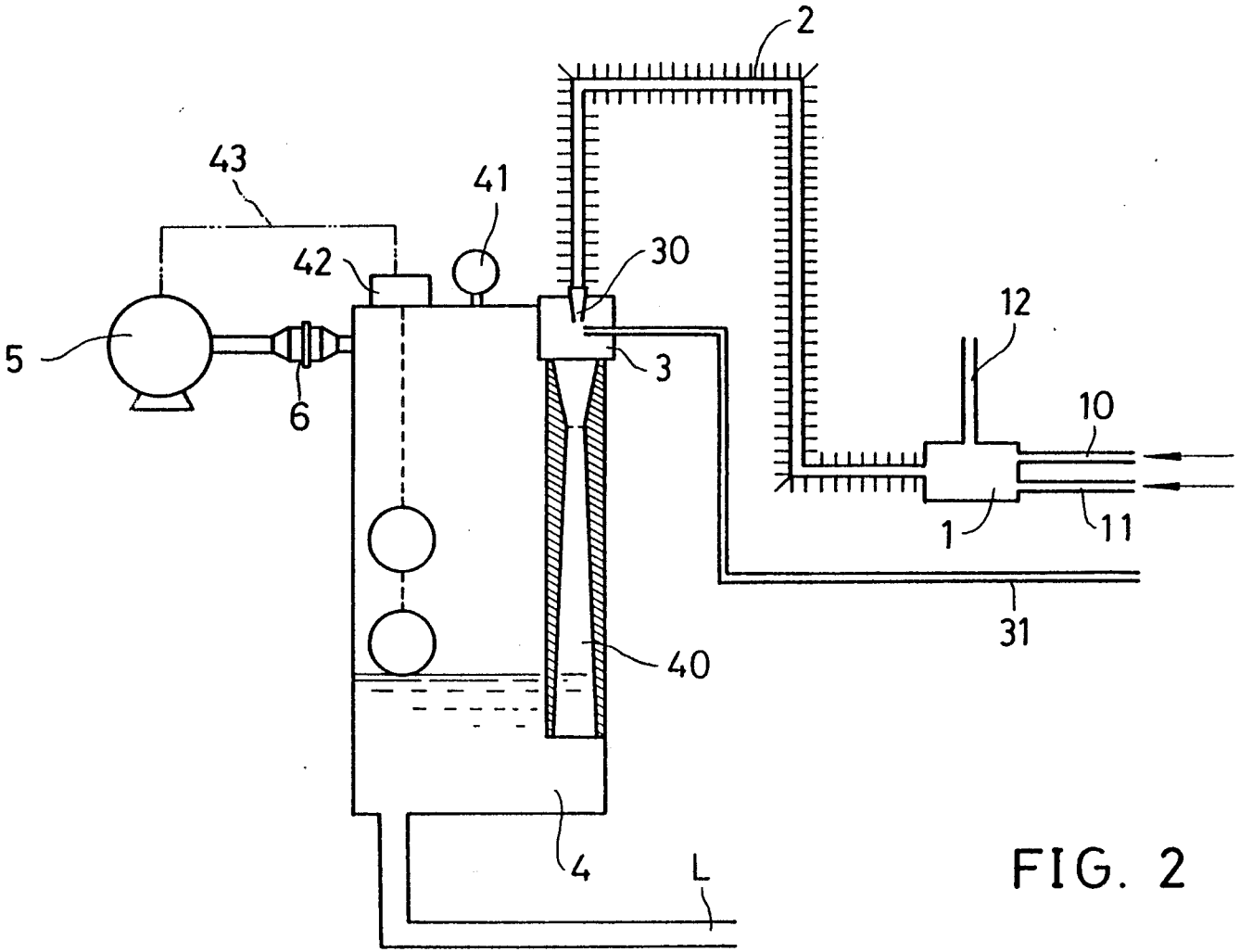
FIG. 2 is an enlarged schematic view showing the structure of the purger in FIG. 1.
Figure 4:
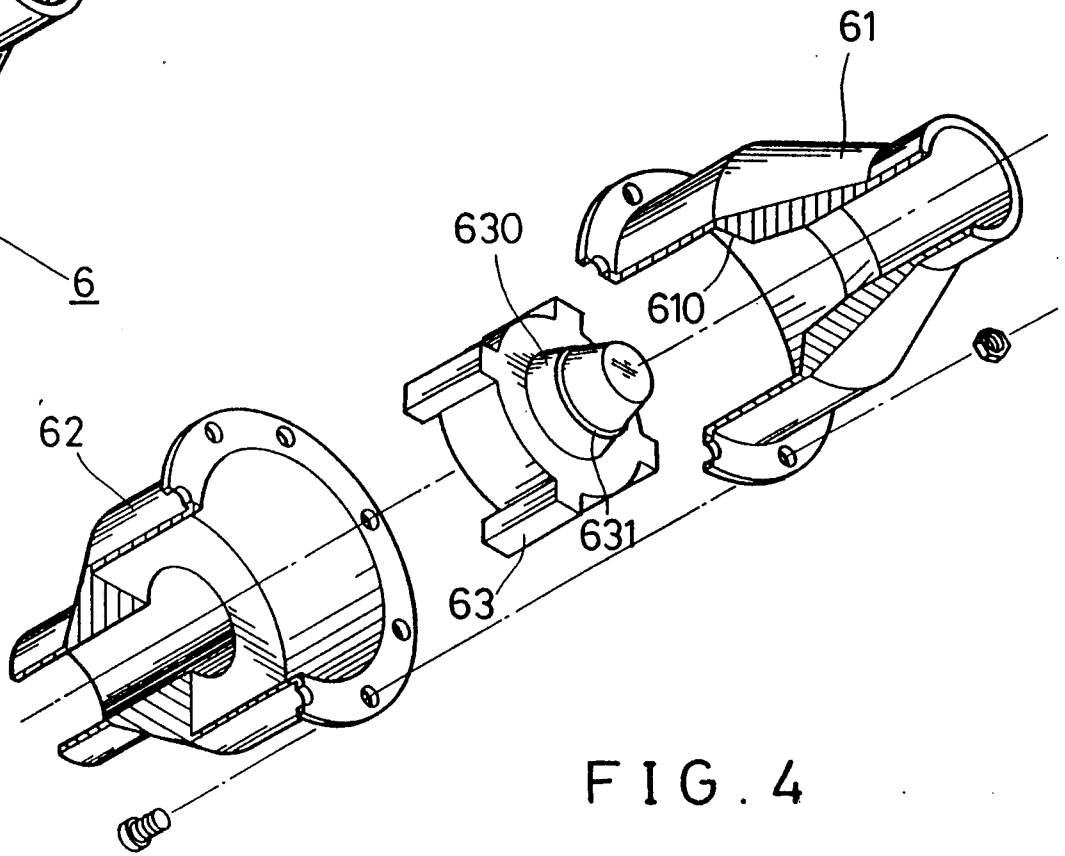
FIG. 4 is an exploded perspective view of the vacuum check valve shown in FIG. 3.
Figure 3:
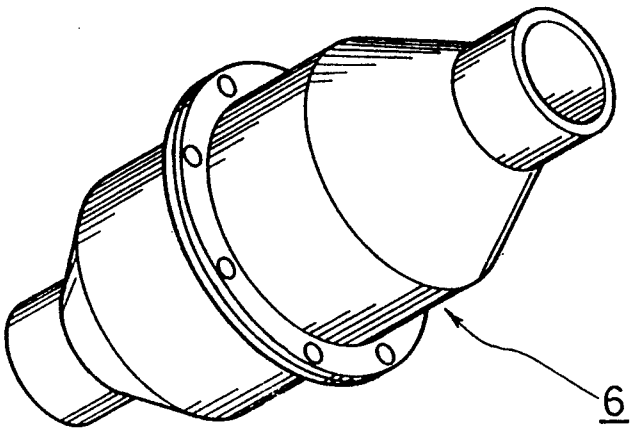
FIG. 3 is a perspective view showing a vacuum check valve for the purger in FIG. 1.

Reference is now made to FIGS. 1 and 2 showing a purger for an absorption heat pump. When the generator A of the heat pump is heated, the absorbing agent (lithum bromide solution) solution contained therein will release vapor refrigerant to the condenser B in which the released vapor refrigerant is condensed to liquid refrigerant to be flowed through an expansion valve C to an evaporator D, and the absorbing agent solution remaining in the generator A becomes a high density one. In the evaporator D, owing to a pressure reduction, the liquid refrigerant coming from the expansion valve C is evaporated which takes away much heat energy from the circulating water flowing through the evaporator D thus converting the incoming circulating water of ambient temperature into cold outgoing water E after passing through evaporator D.

Then, the low temperature vapor refrigerant leaves evaporator D and flows into the absorber F where the low temperature vapor refrigerant meets sprinkled absorbing agent and is absorbed by the latter so as to form low density absorbing agent solution. A pump G pumps the weak solution from the absorber F via pipeline 9 into the generator A for recirculation, and another pump H pumps the weak solution back into the absorber F through an eductor 1 where the low density absorbing agent solution is mixed with high density absorbing agent solution coming from the generator A through a pipeline 10 for increasing the density and thus the refrigerant absorbing ability of the absorbing agent solution. In order to further improve the refrigerant absorbing ability of the absorbing agent solution fed back to the absorber F by lowering the temperature thereof and also to preheat the low density absorbing agent solution pumped into the generator A by the pump G, a heat exchanger K is used for the heat exchange between the fluids in the pipelines 9 and 10.

The automatic purger in accordance with the present invention is mainly characterized by comprising, besides the above-mentioned eductor 1, the arrangement, circled by the phantom line in FIG. 1 and also shown in FIG. 2, including a heat-dissipating tube 2, a purging chamberr 3, a diffuser 40, a storage tank 4, a solution level controller 42, a vacuum pump 5 and a vacuum check valve 6. Eductor 1 includes a second inlet connected to the pipeline 10, a first inlet connected by pipe 11 to pump H, a second outlet connected by a pipe 12 to absorber F, and a first outlet connected by heat-dissipating tube 2 to a nozzle 30 mounted in purging chamber 3. The provision of heat-dissipating tube 2 between nozzle 30 and eductor 1 is to reduce the temperature of the absorbing agent solution introduced from eductor 1 into storage tank 4 through nozzle 30 and diffuser 40 so as to improve the refrigerant absorbing ability of the absorbing agent solution in tank 4, which solution will mix with the absorbing agent solution in absorber F through a pipe L connected between storage tank 4 and absorber F. A pipeline 31 is connected between the absorber F and the purging chamber 3 so that when the mixed absorbing agent solution in eductor 1 is ejected from nozzle 30 into diffuser 40 mounted within storage tank 4 and under purging chamber 3, the non-condensable gas in absorber F will be extracted through pipeline 31 into a low pressure zone formed by the ejected absorbing agent solution around the exit of nozzle 30 in purging chamber 3 and carried away by the same absorbing agent through diffuser 40 into storage tank 4. Since storage tank 4 connected the absorber F by pipe L, the increasing gas pressure in storage tank 4 will gradually lower the solution level therein together with the accumulation of non-condensable gas within tank 4. Storage tank 4 is also provided with a vacuum pressure gauge 41 and a solution level controller 42 electrically coupled through a control circuit 43 to vacuum pump 5 so that vacuum pump 5 will be actuated to begin to purge the accumulated non-condensaible gas in storage tank 4 through check valve 6 when storage tank 4 reaches a predetermined low solution level, and be deenergized to stop gas purging operation when storage tank 4 reaches a predetermined high solution level. Thus, the present invention provides an automatic purger for the absorption heat pump.

While the present invention has been described in terms of what is presently considered to be the most practical and preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An automatic purger for an absorption heat pump having a generator for generating high density absorbing agent solution by heating low density absorbing agent solution, a condenser for condensing vapor refrigerant evaporated when heating absorbing agent solution in said generator, an evaporator for transforming the condensed refrigerant coming from said condenser into vapor refrigerant so as to achieve a cooling effect, an expansion valve connected between said condenser and said evaporator, and an absorber for absorbing the vapor refrigerant coming from said evaporator by absorbing agent so as to form low density absorbing agent solution to be fed back to said generator, the automatic purger comprising:

an eductor having a first inlet connected to said absorber, a second inlet connected to said generator, a first outlet, and a second outlet connected to said absorber;

a storage tank connected to said absorber;

a solution level controller having a first portion mounted in the storage tank and a second portion mounted exteriorly of the storage tank, the first portion including a float for floating on solution in the storage tank and the second portion including control means for activating and deactivating purging of the storage tank, the float and control means being operatively connected;

a purging chamber connected to said absorber and having a nozzle mounted therein which is connected to said first outlet of said eductor by a connecting tube so that absorbing agent solution from said eductor is ejectable into said purging chamber through said nozzle, thus forming a low pressure zone around the exit of said nozzle for extracting non-condensable gas from said absorber into said purging chamber and for carrying said non-condensable gas into said storage tank by ejected absorbing agent solution;

a diffuser connected between said purging chamber and said storage tank for increasing pressure of absorbing agent solution ejected from said nozzle into said storage tank; and a vacuum pump electrically coupled to said control means of the solution level controller and operatively connected to said storage tank so that said vacuum pump will be actuated by the control means to begin purging of non-condensable gas in response to the float in said storage tank reaching a predetermined low solution level, and the vacuum pump will be de-energized to stop purging in response to the float in said storage tank reaching a predetermined high solution level.

2. The automatic purger for an absorption heat pump as claimed in claim 1, wherein said connecting tube is a heat-dissipating tube.

* * * * *